US006559628B2

(12) United States Patent
Kim

(10) Patent No.: US 6,559,628 B2
(45) Date of Patent: May 6, 2003

(54) HIGH VOLTAGE REGULATION CIRCUIT

(75) Inventor: Yong Hwan Kim, Choongcheongbuk-Do (KR)

(73) Assignee: Hynix Semiconductor, Inc., Kyoungki-Do (KR)

( * ) Notice: Subject to any disclaimer, the term of this patent is extended or adjusted under 35 U.S.C. 154(b) by 0 days.

(21) Appl. No.: 10/028,671

(22) Filed: Dec. 28, 2001

(65) Prior Publication Data

US 2002/0084775 A1 Jul. 4, 2002

(30) Foreign Application Priority Data

Dec. 30, 2000 (KR) ..... 2000-87296

(51) Int. Cl.[7] ..... G05F 3/08
(52) U.S. Cl. ..... 323/312; 323/315
(58) Field of Search ..... 323/265, 282, 323/283, 312, 313, 315, 316, 317, 349, 351

(56) References Cited

U.S. PATENT DOCUMENTS 3,840,797 A * 10/1974 Aggen et al. ..... 363/21.17
4,792,749 A * 12/1988 Kitagawa et al. ..... 323/314
4,912,393 A * 3/1990 Anderson et al. ..... 323/313
5,016,156 A * 5/1991 Ogawa ..... 363/21.12
5,120,993 A * 6/1992 Tsay et al. ..... 327/546
5,276,604 A * 1/1994 Messman ..... 363/65
5,497,119 A 3/1996 Tedrow et al.
6,037,762 A * 3/2000 Koelling et al. ..... 323/313

* cited by examiner

*Primary Examiner*—Adolf Denske Berhane
(74) *Attorney, Agent, or Firm*—Birch, Stewart, Kolasch & Birch, LLP

(57) ABSTRACT

A high voltage regulation circuit, in which an output voltage is regulated by the resistance distribution method using a differential amplifier during a normal state but by having a current flow through both ends of the resistors of a high voltage regulator when a noise is inputted thereto. The present invention includes a high voltage regulation part regulating a high voltage by having a constant current flow through both ends of resistors of a high voltage regulator when a noise is inputted thereto, a high voltage level detection part controlling a high voltage regulation operation by detecting that an output voltage is reduced to a level equal to or lower than a predetermined level, and a current mirror part providing the high voltage regulation part with a constant current by being equipped with a current source.

10 Claims, 3 Drawing Sheets

HIGH VOLTAGE REGULATION CIRCUIT

This nonprovisional application claims priority under 35 U.S.C. §119(a) on patent application Ser. No. 87296/2000 filed in Korea on Dec. 30, 2000, which is herein incorporated by reference.

BACKGROUND OF THE INVENTION

1. Field of the Invention

The present invention relates to a semiconductor memory device, and more particularly, to a high voltage regulation circuit influencing on a noise in a device using a high voltage.

2. Description of the Background Art

FIG. 1 illustrates a high voltage regulation circuit according to a related art, which is a Tedrow, et al. regulation circuit disclosed in U.S. Pat. No. 5,497,119.

Referring to FIG. 1, a high voltage regulation circuit according to a related art includes a sample/hold circuit 501 and a regulator circuit 503. In this case, an input voltage $V_{IN}$ is a program voltage Vpp, and an output voltage $V_{OUT}$ is a gate voltage applied to gates of memory cells for programming.

The sample/hold circuit 501 is constructed with an input circuit 505 producing a reference voltage Vref by sampling an input voltage $V_{IN}$, a switch 510 switching the produced reference voltage Vref in accordance with a sample enabling signal SMPLEN, and a voltage reference circuit 515 holding the reference voltage Vref inputted through the switch 510 for a predetermined time. In this case, the input circuit 505 is constructed with a pair of identical resistors R1 and R2 functioning as a voltage distributor and the switch 510 is constructed with an NMOS transistor N1. The voltage reference circuit 515 is constructed with a capacitor C1.

The regulator circuit 503 is constructed with an OP(operational) amplifier 520 of which the non-inversion terminal is connected to an output terminal of the voltage reference circuit 515 and of which the inversion terminal is connected to its output terminal and a programmable divider circuit 525 adjusting the range of the output voltage $V_{OUT}$ by dividing an output voltage of the OP amplifier 520.

The programmable divider circuit 525 is constructed with a plurality of identical resistors R3 to Rk connected in series between an output terminal of the OP amplifier 520 and a ground Vss and a plurality of NMOS transistors N2 to Nk connected in parallel between an output terminal of the circuit 525 and one of the nodes of each of the resistors R3 to Rk so as to switch the output voltage $V_{OUT}$. In this case, operations of a plurality of the NMOS transistors N2 to Nk are controlled by a control voltage provided by a control engine(not shown in the drawing) in accordance with an algorithm.

Operation of the high voltage regulation circuit is explained as follows by referring to FIG. 1. The input circuit 505 produces a reference voltage Vref having a Vpp/2 level by sampling an input voltage $V_{IN}$ of a Vpp level using the resistors R1 and R2. Under the condition of this state, the NMOS transistor N1 of the switch 510 becomes turned on if a sample enabling signal SMPLEN becomes a high level. Then, the capacitor C1 of the voltage reference circuit 515 is charged with the reference voltage Vref produced by the input circuit 505 through the turned-on NMOS transistor N1.

Subsequently, when the sample enabling signal SMPLEN becomes a low level the input circuit 505 is disconnected from the voltage reference circuit 515. Thus, the capacitor C1, of the voltage reference circuit 515 holds the charged reference voltage Vref for a predetermined time(about 1 msec).

Therefore, the regulator circuit 503 determines a resistance ratio in the programmable divider circuit 525 to determine a level of an output voltage $V_{OUT}$, and then regulates the output voltage $V_{OUT}$ in accordance with the determined resistance ratio by taking the reference voltage Vref, which is a non-inversion input of the OP amplifier, as a reference. In this case, the output voltage $V_{OUT}$ is determined by the following formula.

Output Voltage $V_{OUT}$=Vref * (1+R3/Rt), wherein Rt is a total resistance determined by the programmable divider circuit 525.

Namely, each of the resistors R3 to Rk has the same value as the others so as to provide output voltages $V_{OUT}$ increasing constantly. Thus, the control engine defines a maximum voltage, a minimum voltage and a step size effectively so as to provide an output voltage $V_{OUT}$ asked by a specific programming algorithm for the embodiment. For example, a range of the output voltage $V_{OUT}$ is established between 2.7V and 10.8V wherein a level of the output voltage may increase by 20 mV. In this case, a voltage at an output terminal of the OP amplifier 520 is 10.8V and a voltage of the resistor Rk becomes 2.7V.

After the regulation of the output voltage $V_{OUT}$ has been completed, the control engine turns on one of the NMOS transistors N2 to Nk so as to transfer the output voltage $V_{OUT}$ to a flash memory through the turned-on NMOS transistor.

However, if the reference voltage is changed by a noise in the high voltage regulation circuit, the output voltage varies as much as (1+R3/Rt) times of a reference voltage noise. Namely, the high voltage regulation circuit according to the background art fails to provide a stable output voltage due to the reference voltage noise that appears in the output voltage and is amplified by multiplication by a positive number.

SUMMARY OF THE INVENTION

Accordingly, the present invention is directed to a high voltage regulation circuit that substantially obviates one or more problems due to limitations and disadvantages of the background art.

An object of the present invention is to provide a high voltage regulation circuit enabling the minimization of noise influence in a device using a high voltage.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attains by the structure particularly pointed out in the written description and claims hereof as well as the appended drawings.

To achieve these Sects and other advantages and in accordance with the purpose of the invention, as embodied and broadly described herein, a high voltage regulation circuit includes a high voltage regulation part regulating a high voltage by having a constant current flow through both ends of resistors of a high voltage regulator when a noise is inputted thereto, a high voltage level detection part controlling a high voltage regulation operation by detecting that an output voltage is reduced to a level equal to or lower than a predetermined level, and a current mirror part providing the high voltage regulation part with a constant current by being equipped with a current source.

Preferably, the high voltage regulation part includes a high voltage regulator, which includes a first MOS transistor connected in series a between a high voltage and a ground, a first resistor, a second resistor, a second MOS transistor, and a differential amplifier connected to the first MOS transistor, a first pass transistor connected to the first MOS transistor in parallel, a second pass transistor connected to the second MOS transistor in parallel, and a third MOS transistor connected between an output terminal of the differential amplifier and the ground.

Further scope of applicability of the present invention will become apparent from the detailed description given hereinafter. However, it should be understood that the detailed, description and specific examples, while indicating preferred embodiments of the invention, are given by way of illustration only, since various changes and modifications within the spit and scope of the invention will become apparent to those skilled in the art from this detailed description.

BRIEF DESCRIPTION OF THE DRAWINGS

The preset invention will become more fully understood from the detailed description given hereinbelow and the accompanying drawings, which are given by way of illustration only, and thus are not limitative of the present invention, and wherein.

DETAILED DESCRIPTION OF A PREFERRED EMBODIMENT

Generally, a high voltage regulator regulates an output voltage by a resistance distribution method using a differential amplifier. The preferred embodiment of the present invention, which uses basically the resistance distribution method using the differential amplifier, provides both ends of resistors with a predetermined current using a current mirror. This circuit structure prevents the noise amplification due to the differential amplifier.

Figure 1:
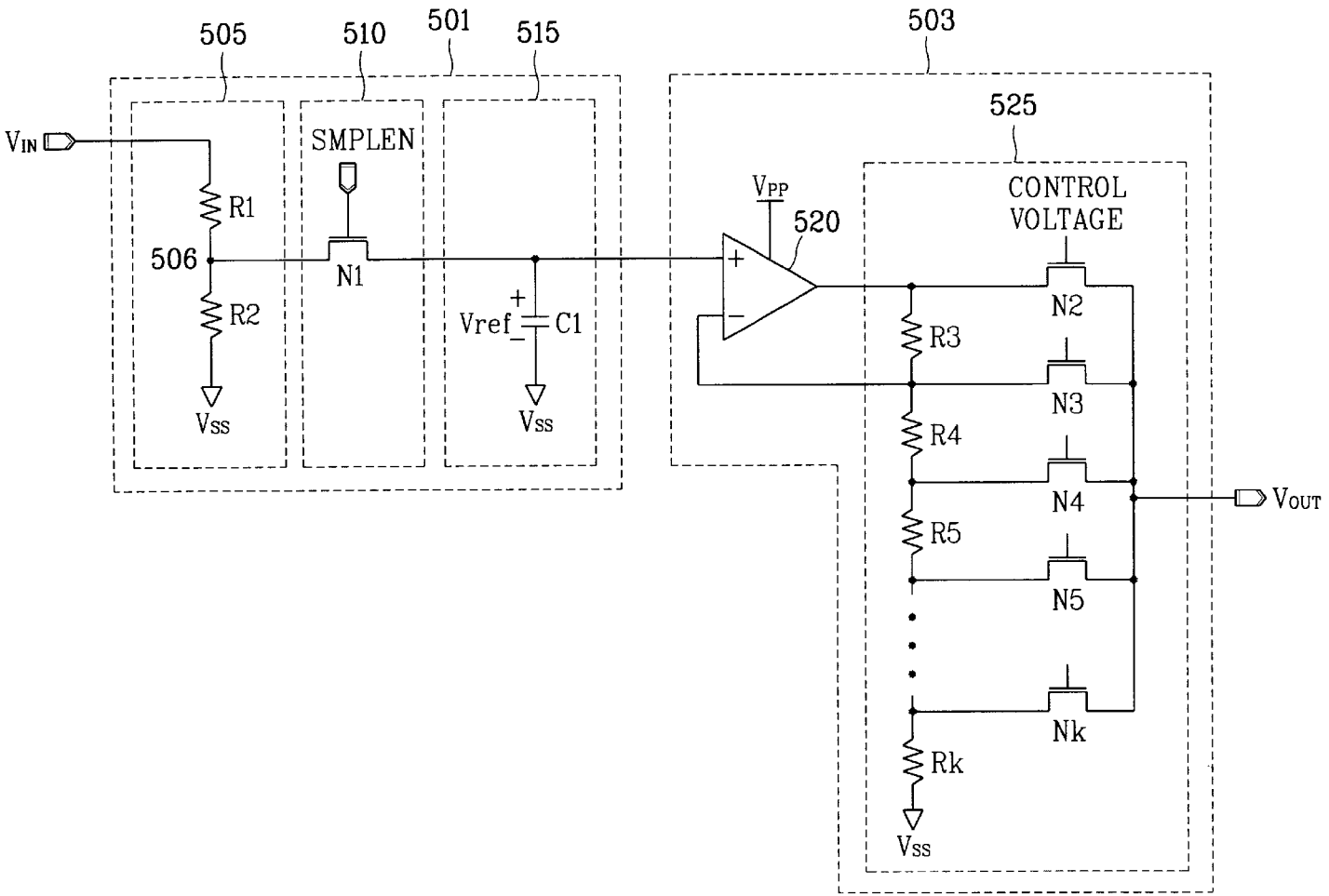
FIG. 1 BACKGROUND ART
FIG. 1 illustrates a high voltage regulation circuit according to the background art.
Figure 2:
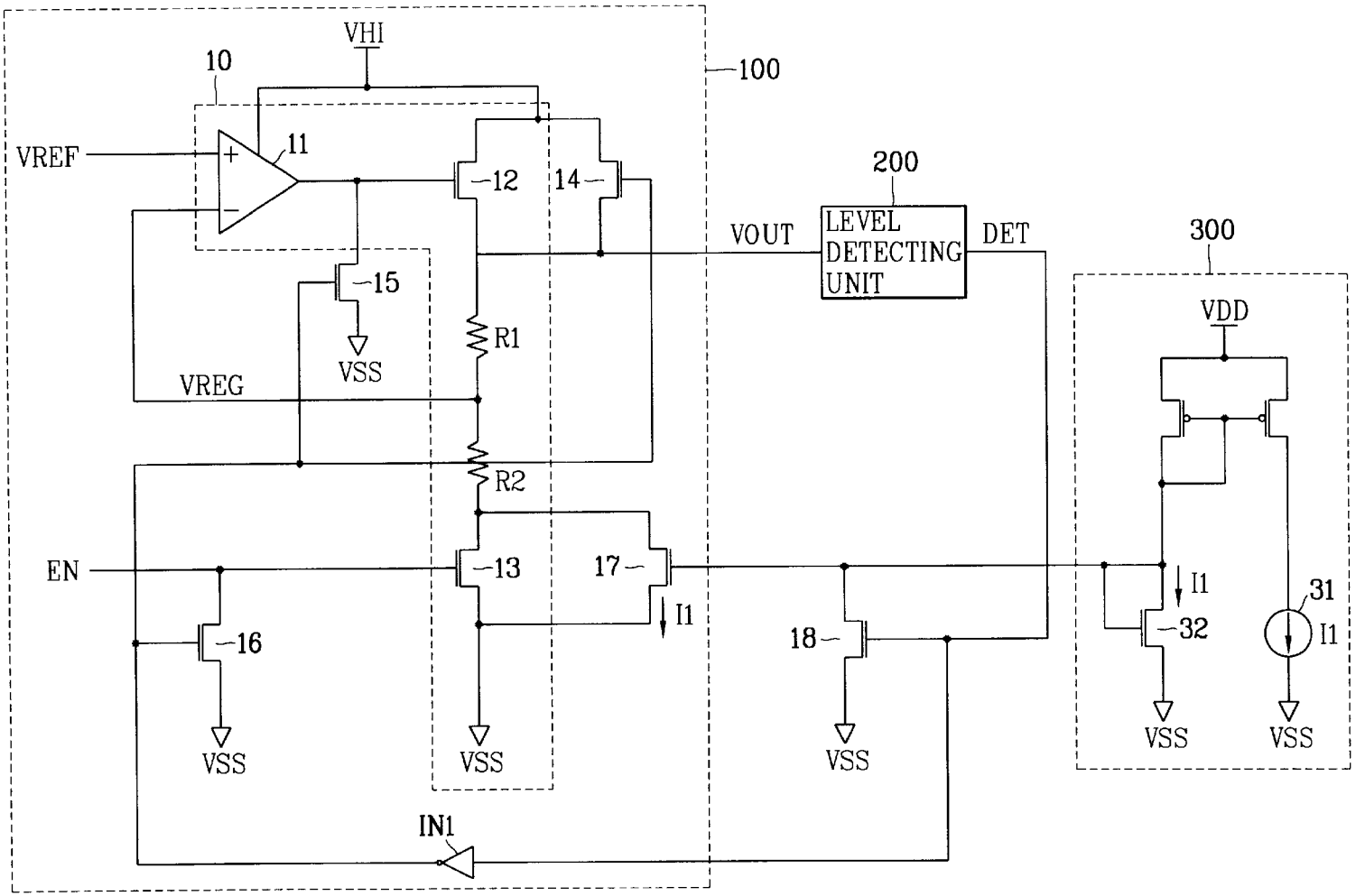
FIG. 2 illustrates a high voltage regulation circuit according to a preferred embodiment of the present invention.

FIG. 2 illustrates a high voltage regulation circuit according to a preferred embodiment of the present invention. Referring to FIG. 2, a high voltage regulation circuit is constructed with a high voltage regulator 100 for regulating an output voltage VOUT in accordance with a reference voltage VREF, a level detection unit 200 for detecting a level variation of the output voltage VOUT due to a noise, and a current mirror unit 300 for maintaining an operation current of the high voltage regulator part 100 when a level of the output voltage VOUT is changed by the noise.

The high voltage regulator part 100, is constructed with a high voltage regulator 10 and various NMOS transistors 13 to 17 for controlling an operation of the high voltage regulator 10. The NMOS transistors 15 and 16 control a differential amplifier 11 and the NMOS transistor 13, respectively. NMOS transistors 13 and 17 function as pass transistors and provide the high voltage regulator 10 with a constant current so as to regulate the output voltage VOUT by a current mirror method when noise occurs. NMOS transistor 18 controls an operation of the pass transistor 17 in accordance with a level detection signal DET, which is output from the level detection unit 200.

Operation of the above-constructed high voltage regulation circuit according to the predetermined embodiment is described as follows with reference to FIGS. 2 and 3.

Figure 3:
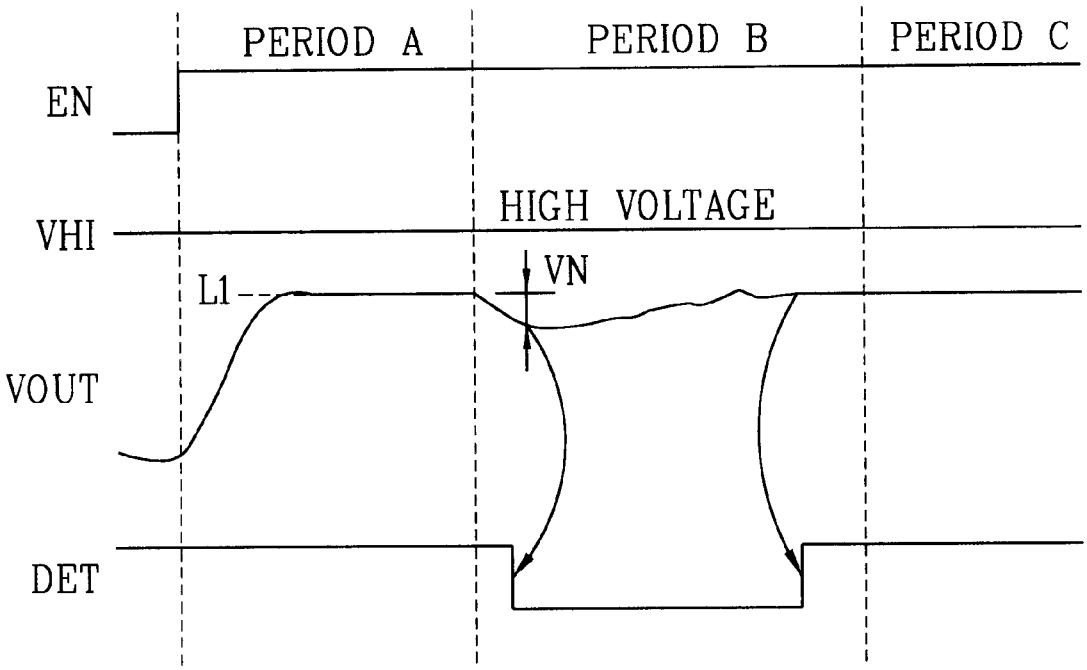
FIG. 3 illustrates a timing operation of the respective constituents in FIG. 2.

FIG. 3 illustrates a timing operation of the respective constituents in FIG. 2. When an enabling signal EN rises to a high level, as shown in FIG. 3, the NMOS transistor 13 is turned on so as to initiate an operation of the high voltage regulator 10. Further, a high voltage VHI is higher than the output voltage VOUT, an operation voltage of the differential amplifier 11 and a source voltage of the output voltage VOUT, simultaneously.

In this case, The level detection unit 200 fails to carry out a detection operation. Thus, as shown in FIG. 3, the level detection signal DET outputted from the level detection unit 200 is at a high level. If the detection signal DET is at a high level, the NMOS transistor 18 is turned on to turn off the pass transistor 17 and the pass transistor 13. In the alternate situation shown in FIG. 3 where the detection signal DET is at a low level, NMOS transistors 15 and 16 become turned off by the detection signal DET of a low level inverted by the inverter IN1.

In FIG. 3, if a level of the output voltage VOUT is lower than a level L1 determined by the resistors R1 and R2 and the reference voltage VREF, a regulation voltage VREG becomes lower than the reference voltage VREF. Therefore, the NMOS transistor 12 is turned on by an output signal of the differential amplifier 11. As a result, a level of the output voltage VOUT starts to increase to an established level L1. In this case, the time for setting up the output voltage VOUT to a determined level L1 is determined in an inner spec. Further, as shown in FIG. 3, after an elapse of the setup time, the output voltage VOUT is maintained constantly.

When the output voltage VOUT is constant, a chip initiates main operations such as read, program and erase using the output voltage VOUT. Once the chip is operated, the level detection unit 200 is also, operated by the main operation of the chip. At this time, the level detection unit 200 is operated so as to detect the level variation of the output voltage VOUT.

If a noise is inputted thereto to change the reference voltage VREF, as shown in FIG. 3, a level of the output voltage VOUT becomes lower than the established level L1. Further, the level of the output voltage VOUT is reduced until the different from the established level L1 becomes equal to or larger than VN. Then, the level detection unit 200, shifts the detection signal DET from high level to low level.

When the detection signal DET is in a low level, the NMOS transistors 13 and 18 are turned off by the low level detection signal DET and the pass transistor 14 and NMOS transistors 15 and 16 are turned on. Thus, the high voltage regulator 10 is free from the operation of the differential amplifier 11. In this case, the pass transistor 17 and the NMOS transistor 32 of the current mirror unit 300 construct the current mirror. This allows the same current 11 flowing through the current source 31 to flow through the pass transistor 17.

Since a constant current 11 flows through the pass transistor 17 and resistors R1 and R2, the output voltage VOUT is affected not by the amplified noise but by a noise simply inputted thereto.

If the level of the output voltage VOUT increases again, the level detection signal DET outputted from the level detection part 20, as shown in FIG. 3, is shifted from low level to high level again. Hence, the output voltage VOUT is regulated by the resistance distribution method using a differential amplifier normally.

Accordingly, a high voltage regulation circuit according to the present invention regulates an output voltage not using a differential amplifier but by using a current mirror when a noise occurs. Namely in the present invention, a current, which is the same as the current flowing through the current mirror, flows through both ends of the resistors of a high voltage regulator when a noise is inputted thereto. Thus, the present invention enables to minimize the influence caused by the noise by preventing the noise amplification due to a conventional differential amplifier.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A high voltage regulation circuit comprising:

a high voltage regulation part for regulating a high voltage by having a constant current flow through both ends of resistors of a high voltage regulator when a noise is inputted thereto;

a high voltage level detector for controlling a high voltage regulation operation by detecting that an output voltage is reduced to a level equal to or lower than a predetermined level; and a current mirror circuit providing the high voltage regulation part with a constant current by being equipped with a current source.

2. The high voltage regulation circuit of claim 1, wherein the high voltage regulation part regulates the output voltage by a resistance distribution method using a differential amplifier in the high voltage regulator during a normal state.

3. The high voltage regulation circuit of claim 1, wherein the high voltage level detection part initiates a detection operation when the output voltage is set as a predetermined level.

4. The high voltage regulation circuit of claim 1, the high voltage regulation part comprising:

a high voltage regulator comprising:

a first MOS transistor connected in series between a high voltage and a ground;

a first resistor;

a second resistor;

a second MOS transistor; and a differential amplifier connected to the first MOS transistor;

a first pass transistor connected to the first MOS transistor in parallel;

a second pass transistor connected to the second MOS transistor in parallel; and a third MOS transistor connected between an output terminal of the differential amplifier and the ground.

5. The high voltage regulation circuit of claim 4, wherein the high voltage regulation part further comprises a fourth MOS transistor for controlling an operation of the second MOS transistor in accordance with an inverted level detection signal.

6. The high voltage regulation circuit of claim 4, wherein the high voltage regulation part further comprises a fifth MOS transistor for controlling an operation of the second MOS transistor in accordance with a level detection signal.

7. The high voltage regulation circuit of claim 4, wherein the high voltage is higher than a power source voltage.

8. The high voltage regulation circuit of claim 4, wherein the first to third MOS transistors and the first and second pass transistors are NMOS transistors.

9. The high voltage regulation circuit of claim 4, wherein the first and second MOS transistors are turned off when the level detection signal becomes active and wherein the first and second pass transistors are turned on when the level detection signal becomes active.

10. The high voltage regulation circuit of claim 4, wherein a current identical to that of a current source of the current mirror part flows through the second pass transistor when the level detection signal becomes active.

* * * * *